US006106436A

United States Patent [19]

Lundahl

[11] Patent Number: 6,106,436

[45] Date of Patent: Aug. 22, 2000

[54] EXERCISE DEVICE AND METHOD TO SIMULATE KAYAK PADDLING

[76] Inventor: Robert Dana Lundahl, 5830 Jefferson Blvd., Frederick, Md. 21703

[21] Appl. No.: 08/568,649

[22] Filed: Dec. 7, 1995

[51] Int. Cl.[7] ..... A63B 69/00

[52] U.S. Cl. ..... 482/1; 482/7; 482/72; 482/903; 482/110

[58] Field of Search ..... 482/1–8, 70–73, 482/900–903, 115, 114, 110, 51

[56] References Cited

U.S. PATENT DOCUMENTS

| | | | |
|---|---|---|---|
| 4,687,197 | 8/1987 | Larsson et al. | 482/73 |
| 4,717,145 | 1/1988 | Chininis | 482/73 |
| 4,884,800 | 12/1989 | Duke | 482/73 |
| 4,940,227 | 7/1990 | Coffey | 482/73 |
| 5,062,632 | 11/1991 | Dalebout et al. | 482/7 |
| 5,354,251 | 10/1994 | Sleamaker | 482/96 |

*Primary Examiner*—Richard J. Apley
*Assistant Examiner*—Glenn E. Richman

[57] ABSTRACT

This invention describes an exercise machine which is operated in a manner similar to paddling a Kayak or other water craft with a double blade paddle. The device incorporates a "T" bar shaped handle assembly centrally positioned in front of a seated operator and connected at its base with an articulating joint to a torque resisting mechanism. The articulating joint allows the operator to manipulates the handle bar in a pattern similar to that of paddling a Kayak as this configuration allows the handle bar to pivot and be positioned from side to side with a similar freedom of movement experienced with a Kayak type double blade paddle. Only the rotational component of the handle bar movement induced by paddle stroke motions are transmitted through the articulating joint and resisted by the torque resistance mechanism. The torque resistance mechanism utilizes a mechanical configuration where the alternating and reversing rotations of the handle bar movement are transformed into a unidirectional rotation of a flywheel where the combination of rotational inertia and an adjustable drag device provide an dynamic exercise resistance which is similar to that which is actually experienced while propelling a Kayak.

6 Claims, 4 Drawing Sheets

Aerodynamic
Fan resistance

Magnetic
Eddy Current
Resistance

Active Electromotive
Resistance with
Control and feedback

EXERCISE DEVICE AND METHOD TO SIMULATE KAYAK PADDLING

BACKGROUND OF THE INVENTION

Many previous exercise machines attempt to simulate the motion and effort of rowing. Exercise machines of this type are typically called "rowers" and are designed to be operated with single or multiple handles which are pulled toward the chest with reciprocating strokes in approximate linear or curvilinear path and these motions are resisted by a resistance mechanism. For the operator these strokes are fundamentally all pulling strokes and are intended to utilize body muscles typical of those required in actual rowing.

This invention describes a machine which approximates the motion and effort of Kayak paddling with a mechanical configuration which provides a unique combination of freedom of movements and a rotational component of resistance. The a single handle bar assembly is free to articulate fore and aft and side to side, and only the rotation of the handlebar about center is resisted by the resistance mechanism. For the operator this mechanism allows the handle bar to be operated with a motion similar to that used in paddling a Kayak. With this configuration the operator can perform pulling or pushing strokes, alternating from side to side as in an actual Kayak. This mode of exercise resistance requires a torsional type of input from the operator and is intended to utilize a set of body muscles more typical for the sport of Kayaking.

A further object of this invention is to describe a preferred embodiment of a resistance mechanism which is economical to produce and provides a mechanical resistance that is smooth, quiet, and produces a dynamic feel similar to the inertia and drag experienced in propelling a or Kayak water craft.

DETAILED DESCRIPTION OF THE INVENTION

Figure 1A:
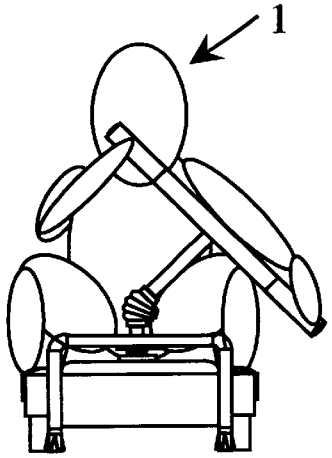
FIG. 1 shows an overview of the invention and the orientation of the operator.
Figure 1B:
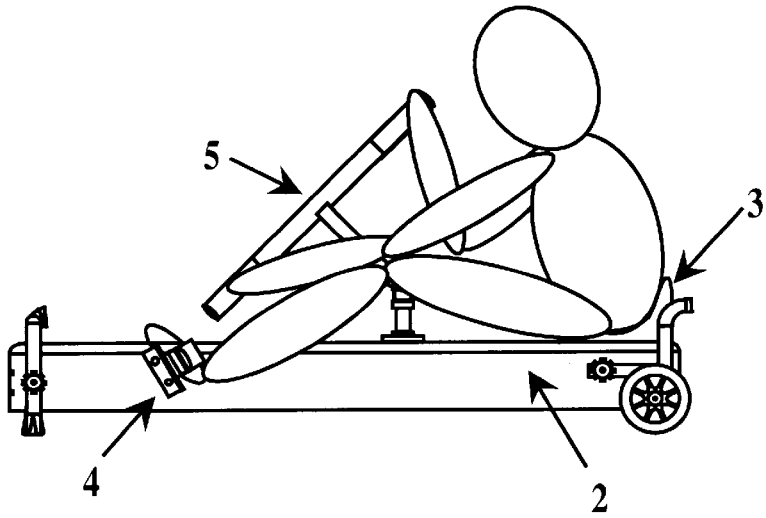

FIG. 1 illustrates one embodiment of the invention and the orientation of the operator. The operator (1) sits on the base structure (2) of the machine which provides the seating surface (3) and foot rests (4). The operator uses the machine by performing paddling motions with the handle bar (5).

Figure 2:
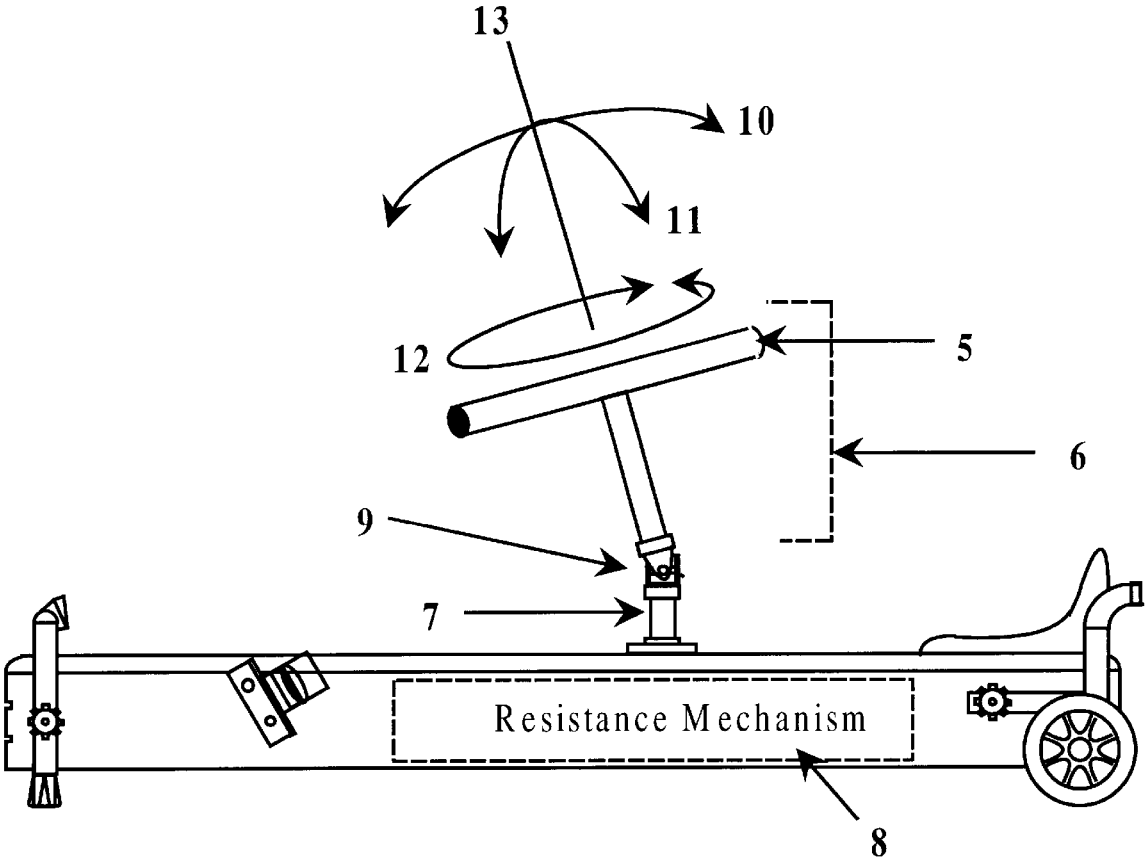
FIG. 2 shows detailed view of the invention and the component parts of the handle assembly, articulating joint, and the associated freedom of movements and direction of exercise resistance.

FIG. 2 illustrates the mechanical configuration and resultant freedoms of movement and resistance used by this device to approximate the physical action of paddling a Kayak. This figure shows how the handle bar (5) is part of the handle assembly (6) and is connected to the input shaft (7) of the resistance mechanism (8) through an articulating type universal joint (9). The articulating joint (9) permits the handle bar (5) of the handle assembly (6) to freely pivot in the fore and aft direction (10) as well as the side to side direction (11). Handle bar rotations (12) about the handle assembly centerline (13) are transmitted through the articulating joint (9) to the input shaft (7) and to the resistance mechanism (8).

Figure 3:
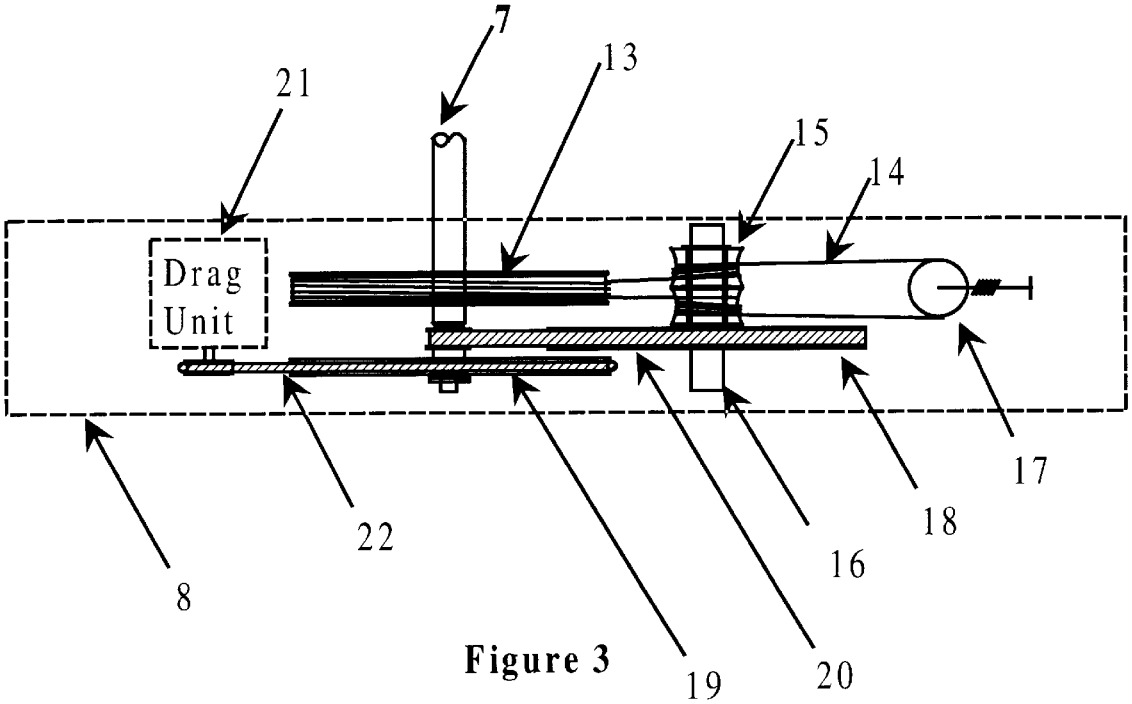
FIG. 3 shows a detailed view of the preferred embodiment of the torque resistance mechanism.

FIG. 3 illustrates one embodiment of a torque resistance mechanism (8) although many such configurations could be utilized. The preferred embodiment shown describes a torque resistance mechanism which utilizes the rotational inertia of a high speed flywheel combined with a steady load of a drag mechanism. An intended benefit of this type of configuration is to approximate the actual resistance encountered when paddling a water craft where there is mechanical work required to overcome the inertia of the craft as well as continuing work required to overcome the hydrodynamic resistance of continued movement. A additional benefit of the proposed embodiment is the smoothness of operation by the utilization of belt drives and the ease and economy of manufacture. In this embodiment the main input shaft (7) is rigidly affixed with a main drive wheel (13) of a relatively large diameter. Around the main drive wheel (13) is fitted an endless drive belt or cable (14) which exhibits high tensile strength and low stretch. The drive belt (14) is friction driven from several wraps around the diameter of the primary drive wheel (13) and the two exiting sides pass around two smaller one-way clutch sheaves (15) mounted on the secondary drive shaft (16). Each side of the drive belt (14) is wrapped several times around the corresponding one-way clutched sheaves (15) . Each of the one-way clutched sheaves (15) is wrapped with the drive belt (14) in the same circumfrential direction. The clutch sheaves (15) incorporate needle bearing clutches so that the will rotate freely in one direction on the secondary drive shaft (16) and will engagement in the other. The direction of engagement of both clutched sheaves (15) is the same and the direction of engagement is oriented so that when the drive belt (14) is in tension and being reeled in by the rotation of the primary drive wheel (13), the clutched sheaves will engage and drive the secondary drive shaft (16). The opposing clutched sheaves (15) turns freely as the drive belt is reeled out from the primary drive wheel (13). The rotation of the secondary drive shaft (16) is always in the same direction regardless of the direction of rotation of the input shaft (7) or primary drive wheel (13). The remainder of the drive belt (14) loop exits the clutch sheaves (15) and is passed around a tensioning wheel (17) which maintains the tension for the friction drive system. In summary, the paddling motions imparted to the handle bar (5) will impart oscillating, reversing, and partial rotations to the input drive shaft (7) and main drive wheel (13). The friction drive belt (14) and its path around the clutched sheaves (15) transform the oscillations of the input drive shaft (7) to a unidirectional and higher speed rotation of the secondary drive shaft (16).

A secondary drive sheaves (18) of relatively larger diameter is affixed to the secondary drive shaft (16) and drives the high speed flywheel (19) through the secondary drive belt (20) and provides a further increase in rotational speed by the relatively small diameter of the driven sheaves of the high speed flywheel (19). The high speed flywheel (19) is shown in this embodiment as located on the input drive shaft (7) where it is bearing mounted and allowed to free wheel. The high speed flywheel (19) provides the inertial resistance to paddling motion inputs made with the handle bar (5) since by virtue of the mechanical ratios small changes in input speed cause relatively large changes in the rotational velocity and stored energy of the high speed flywheel (19). The drag mechanism (21) is an additional device used to provide an overall resistance to the rotation of the high speed flywheel (19) and it is driven by the final drive belt (22). This drag mechanism is intended to provide an additional drag function which will simulate the hydrodynamic resistance of a moving Kayak.

Figure 4A:
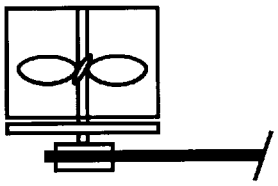
FIG. 4 shows sample details of suggest drag mechanisms.
Figure 4B:
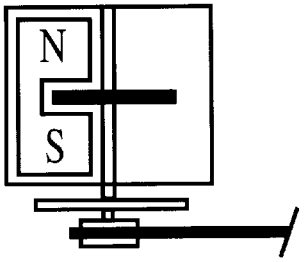
Figure 4C:
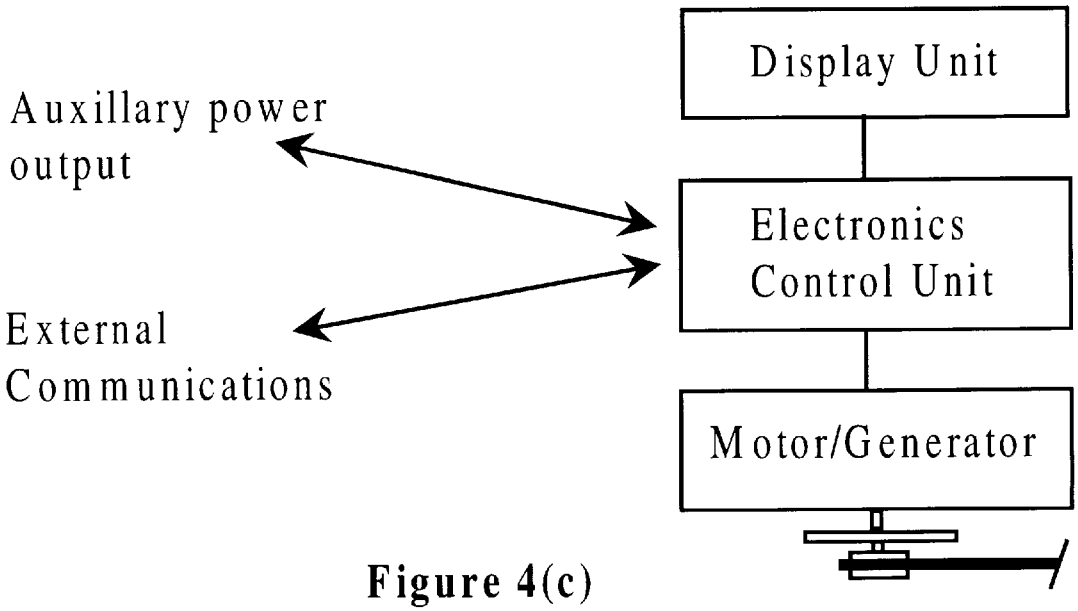

FIG. 4 presents a several different embodiments of smooth and wear free drag mechanism although many others may be envisioned.

A simple aerodynamic fan resistance unit (23) can be utilized where a fan functions as an air mover. With this approach the induced drag resistance is a function of velocity and the overall level of resistance can be further modified by restricting to the air flow through the driven fan. A magnetic eddy current resistance unit (24) is another simple approach to introduce a velocity dependent drag resistance where the rotation of a flywheel made of electrically conductive material is resisted by internal eddy currents caused by a magnetic field. In this configuration the gap and/or proximity of the magnetic field is altered with respect to the flywheel to provide and overall adjustment to the drag resistance.

Another very capable approach would utilizes the electromotive drag resistance (25) of a motor/generator combined with the control logic of a programmable controller. Control logic will sense the current output from a small driven generator and by current control and generator/motor loading, modify the drag induced by the generator. This configuration can provide exercise load control, accurate performance monitoring, display accessories and generate power for external devices.

What is claimed is:

1. An exercise device comprising a base; a seating surface; a single "T" shaped handlebar; an articulating joint; a torque resistance mechanism; a flywheel; said seating surface incorporating said single "T" shaped handlebar; said "T" shaped handlebar centrally positioned in front of a seated operator and is connected at its base to said articulating joint which is connected to said torque resistance mechanism; said articulating joint allows the handle bar to be pivoted about its connection wherein said articulating joint will transmit the rotational component of torque imparted by rotation of the handlebar about its centerline which is connected to said torque resistance mechanism for transforming the oscillating and reversing rotation of the handlebar about its centerline into a unidirectional high speed rotation to said flywheel, thereby providing an inertial resistance to the user.

2. An exercise device in accordance with claim 1 wherein a drag device is attached to the flywheel and wherein said drag device provides a resistance to the flywheel rotation that is a function with respect to the flywheel speed.

3. An exercise device in accordance with claim 1 wherein a drag device is attached to the flywheel and wherein said drag device provides a resistance to the flywheel rotation that is a variable function with respect to the flywheel speed.

4. An exercise device in accordance with claim 1 wherein a drag device is attached to the flywheel and wherein said drag device provides a resistance to the flywheel rotation that is a function of the flywheel speed and this function is under electronic control.

5. An exercise device in accordance with claim 1 wherein a drag device is attached to the flywheel and wherein said drag device provides a resistance to the flywheel rotation that is a function under electronic programmable control.

6. An exercise device in accordance with claim 1 wherein a drag device is attached to the flywheel and wherein said drag device provides a resistance to the flywheel rotation that is a function under electronic programmable control and control parameters form said electronic programmable control are dynamically communicated to and modified by external programmable controls.

* * * * *